US011128064B2

(12) United States Patent
Berghahn et al.

(10) Patent No.: US 11,128,064 B2
(45) **Date of Patent: *Sep. 21, 2021**

(54) CONNECTION DEVICE FOR CONNECTING A SHIELD CONDUCTOR OF AN ELECTRIC LINE TO A GROUNDING SECTION

(71) Applicant: Phoenix Contact GmbH & Co. KG, Blomberg (DE)

(72) Inventors: Kevin Berghahn, Blomberg (DE); Jens Andresen, Blomberg (DE); Heinz Reibke, Bad Salzuflen (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/043,013

(22) PCT Filed: Mar. 20, 2019

(86) PCT No.: PCT/EP2019/056906

§ 371 (c)(1),
(2) Date: Sep. 29, 2020

(87) PCT Pub. No.: WO2019/192842

PCT Pub. Date: Oct. 10, 2019

(65) Prior Publication Data

US 2021/0013636 A1 Jan. 14, 2021

(30) Foreign Application Priority Data

Apr. 3, 2018 (BE) ..... 2018/5225

(51) Int. Cl.

| | |
|---|---|
| ***H01R 4/66*** | (2006.01) |
| ***H01R 4/48*** | (2006.01) |
| ***H01R 4/64*** | (2006.01) |
| ***H01R 9/26*** | (2006.01) |
| ***H01R 13/24*** | (2006.01) |

(Continued)

(52) U.S. Cl.

CPC ..... *H01R 4/4809* (2013.01); *H01R 4/646* (2013.01); *H01R 9/2691* (2013.01); *H01R 13/2464* (2013.01)

(58) Field of Classification Search

CPC ..... H01R 13/65802; H01R 13/2414; H01R 4/64; H01R 12/585; H01R 23/722

(Continued)

(56) References Cited

U.S. PATENT DOCUMENTS 5,727,966 A * 3/1998 Alpert ..... H01R 13/72 439/418
5,901,220 A * 5/1999 Garver ..... H04Q 1/021 379/399.01

(Continued)

FOREIGN PATENT DOCUMENTS

DE 3428054 A1 2/1986
DE 19610854 A1 9/1997

(Continued)

*Primary Examiner* — Phuong Chi Thi Nguyen

(74) *Attorney, Agent, or Firm* — Leydig, Voit & Mayer, Ltd.

(57) ABSTRACT

A connection device for connecting a shield conductor of an electrical cable to a grounding section includes: a housing surrounding a receiving space into which an electrical cable is insertable with a shield conductor along a longitudinal axis, the housing being attachable to the grounding section such that the grounding section extends at least partly in the receiving space; and a spring element which is adjustably disposed on the housing and which has a clamping leg and is movable from an open position to a clamped position relative to the housing such that when in the clamped position, the spring element acts with the clamping leg on the shield conductor of the electrical cable inserted in the receiving space, the clamping leg having an engagement (Continued)

portion for acting on the shield conductor, the engagement portion having an at least partially curved or angled engagement contour.

22 Claims, 8 Drawing Sheets

(58) Field of Classification Search
USPC ... 439/95, 91, 92, 96, 591, 83, 82, 751, 943
See application file for complete search history.

(56) References Cited

U.S. PATENT DOCUMENTS 8,662,760 B2 * 3/2014 Cline ..... G02B 6/3887 385/76
2007/0077814 A1 * 4/2007 Sullivan ..... H01R 9/0515 439/581
2009/0269968 A1 * 10/2009 Nemoto ..... H01R 12/88 439/377
2017/0125991 A1 5/2017 Johnson et al.
2020/0313315 A1 10/2020 Andresen

FOREIGN PATENT DOCUMENTS

DE 20003081 U1 4/2000
DE 19917407 C1 12/2000
DE 20014918 U1 5/2001
DE 202015102037 U1 5/2015
DE 102016110393 A1 12/2017
EP 0780923 A1 6/1997
WO WO 2016166132 A1 10/2016

* cited by examiner

CONNECTION DEVICE FOR CONNECTING A SHIELD CONDUCTOR OF AN ELECTRIC LINE TO A GROUNDING SECTION

CROSS-REFERENCE TO PRIOR APPLICATIONS

This application is a U.S. National Phase application under 35 U.S.C. § 371 of International Application No. PCT/EP2019/056906, filed on Mar. 20, 2019, and claims benefit to Belgian Patent Application No. BE 2018/5225, filed on Apr. 3, 2018. The International Application was published in German on Oct. 10, 2019 as WO 2019/192842 under PCT Article 21(2).

FIELD

The invention relates to a connection device for connecting a shield conductor of an electrical cable to a grounding section.

BACKGROUND

Such a connection device has a housing surrounding a receiving space into which an electrical cable is insertable with a shield conductor along a longitudinal axis. The housing is attachable to a grounding section in such a way that the grounding section extends at least partly in the receiving space.

Such a connection device, also known as shield clamp, is used for contacting a shield conductor over a large area with a grounding section, for example, a busbar, a mounting rail, or a housing wall of an electrical system (for example, a control cabinet). The contact should be resistant, in particular temperature- and corrosion-resistant (even in a hostile environment) and resistant to vibration in order to provide for reliable grounding of the shield conductor to the grounding section over the life of the electrical system.

Conventional connection devices are relatively complex in design, use a multitude of components, and are correspondingly expensive to manufacture.

DE 20 2015 102 037 U1 describes a structural clamp where a grounding section in the form of a metallic conductor and an electrical cable can be inserted into a housing. Disposed on the housing is a clamping screw via which the electrical cable can be clampingly contacted to the metallic conductor.

DE 200 14 918 U1 describes a connection element for connecting a cable shield of a shield cable to terminals of at least one module, where a plate is biased relative to a housing by spring elements. A shield cable can be electrically contacted via the plate.

In the case of a clamp assembly known from DE 196 108 541 A1, a shield conductor of an electrical cable can be attached to spring terminals for electrical contacting to a busbar. DE 199 17 407 C1 describes a shield connection clamp for supporting a shield conductor of an electrical cable on a rail having a dissipation potential, in particular a ground potential. An adjusting screw has a pressure piece having a curved contour for engagement with the shield conductor.

In the case of a spring terminal known from WO 2016/166132 A1, clamping springs are provided for connecting two conductors to the connecting terminal and which have a contact leg for each of these.

SUMMARY

In an embodiment, the present invention provides a connection device for connecting a shield conductor of an electrical cable to a grounding section, the connection device comprising: a housing surrounding a receiving space into which an electrical cable is insertable with a shield conductor along a longitudinal axis, the housing being attachable to the grounding section such that the grounding section extends at least partly in the receiving space; and a spring element which is adjustably disposed on the housing and which has a clamping leg and is movable from an open position to a clamped position relative to the housing such that when in the clamped position, the spring element is configured to act with the clamping leg on the shield conductor of the electrical cable inserted in the receiving space, the clamping leg having an engagement portion configured to act on the shield conductor, the engagement portion having an at least partially curved or angled engagement contour at a side facing the shield conductor as viewed in a plane perpendicular to the longitudinal axis.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
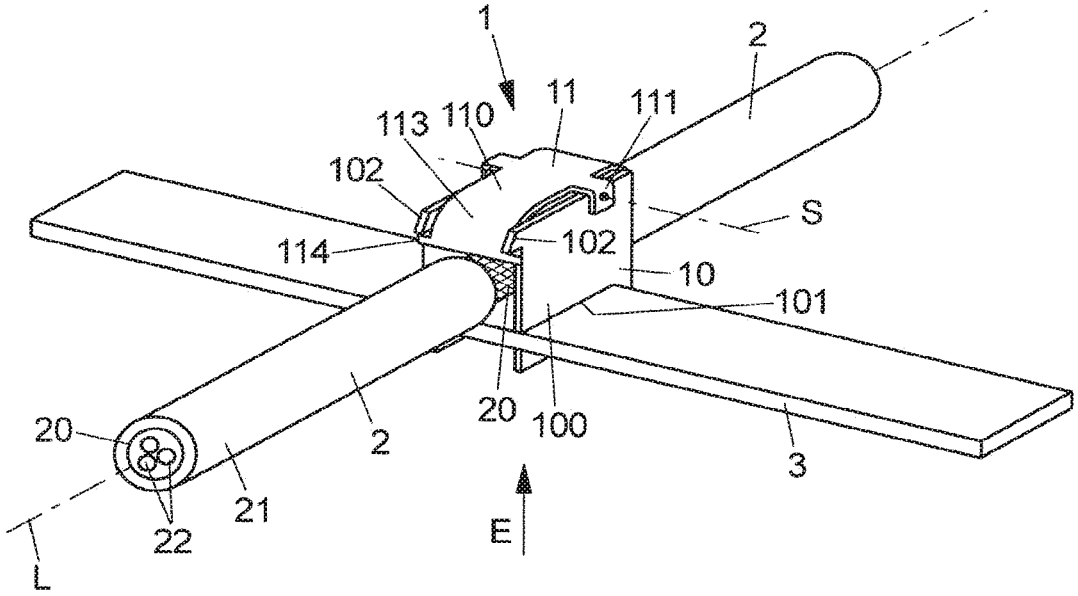
FIG. 1 is a schematic view of a connection device for electrically contacting a shield conductor of an electrical cable to a grounding section, for example, in the form of an electrical busbar or in the form of an edge of a housing of an electrical system.

In an embodiment, the present invention provides a connection device that allows a shield conductor of an electrical cable to be reliably and stably contacted to a grounding section (e.g., a busbar, a mounting rail, or an edge of a housing of an electrical system) and at the same time is easy to operate and which, under certain circumstances, can also be released from a clamped position.

Accordingly, the connection device has a spring element which is adjustably, in particular pivotably, disposed on the housing and which has a clamping leg and is movable from an open position to a clamped position relative to the housing such that when in the clamped position, it acts with the clamping leg on a shield conductor of an electrical cable inserted in the receiving space. The clamping leg has an engagement portion for acting on the shield conductor, the engagement portion having an at least partially curved or angled engagement contour at a side facing the shield conductor, as viewed in a plane perpendicular to the longitudinal axis.

Accordingly, the connection device has a spring element which is adjustably, in particular pivotably, disposed on the housing and which can be brought with a clamping leg into engagement with a shield conductor of an electrical cable which shield conductor is inserted in the receiving space of the connection device. The spring element may be manufactured, for example, from a spring steel material and thus may in itself be elastic, so that a clamping contact can be established between the shield conductor and the grounding section and, for example, an aging-related change in the shape of the shield conductor or of the grounding section can be compensated for without impairing the contact between the shield conductor and the grounding section.

To enable the clamping leg to engage in an advantageous manner with the shield conductor (which may, in particular, have a cylindrical basic shape matching the shape of the electrical cable), in particular to provide for EMC-compatible, large-area contacting, the clamping leg has an engagement portion via which the clamping leg can be brought into (areal) engagement with the shield conductor and which is matched in shape to shield conductor. Thus, the engagement portion provides a curved or angled engagement contour (as viewed in a plane perpendicular to the longitudinal axis along which the shield conductor can be inserted into the receiving space of the housing of the connection device), so that the engagement portion can rest against the shield conductor in areal contact therewith at least over a portion thereof, as viewed in the circumferential direction about the longitudinal axis. This allows force to be applied in an advantageous manner, while at the same time providing for an advantageous, areal contact with the shield conductor. In addition, the firm seating of the shield conductor in the housing of the connection device can be improved, because the shield conductor is held by the engagement contour in position within the housing also in the plane perpendicular to the longitudinal axis, and thus cannot be moved transversely to the longitudinal axis (tangentially to the grounding section) relative to the clamping leg.

In an embodiment, the engagement portion has a first contact portion and a second contact portion, which together form the engagement contour. The contact portions may be formed in the manner of contact tongues and are preferably separated from each other by a slit extending longitudinally along the clamping leg, so that the contact portions can elastically conform to the cable, basically independently of each other. Thus, the contact portions enable an advantageous engagement with the electrical cable, possibly compensating for structural tolerances of the connection device and for tolerances in the shape of electrical cable.

The first and/or second contact portion(s) may, for example, be at least partially curved in the plane perpendicular to the longitudinal axis. The contact portions may, for example, together form a semicircular engagement contour. Additionally or alternatively, the contact portions may be disposed at an angle to one another. In this case, the contact portions may, for example, each extend at least partially in a straight line, so that, for example, a V-shaped engagement contour is created in the plane perpendicular to the longitudinal axis. The first contact portion and the second contact portions may be preferably describe an obtuse angle with respect to one another (as viewed in the plane perpendicular to the longitudinal axis).

In an embodiment, at least a third contact portion is disposed between the first contact portion and the second contact portion (as viewed in the circumferential direction about the longitudinal axis). The contact portions may be separated from each other, for example by slits extending longitudinally along the clamping legs, so that the contact portions can resiliently deflect relative to one another.

The first contact portion and/or the second contact portion and/or the third contact portion may themselves be at least partially curved (as viewed in the plane perpendicular to the longitudinal axis). Thus, the contact portions may together form a semicircular engagement contour. Additionally or alternatively, the contact portions may be angled relative to each other, the third contact portion describing a preferably obtuse angle with respect to both the first contact portion and the second contact portion (as viewed in the plane perpendicular to the longitudinal axis).

The spring element is preferably integrally formed with its contact portions as a single piece. The contact portions are formed on the clamping leg in that they are cut free from one another by slits and thus can be moved resiliently relative to one another.

It is also conceivable and possible that the spring element may be provided at its clamping leg with more than three contact portions which are separated from one another, for example by slits, and which together form the engagement contour.

In an embodiment, the spring element of the connection device is pivotable relative to the housing. Because the spring element is pivotably supported on the housing, the spring element is easy to operate. The spring element can easily be moved between the open position and the clamped position by pivoting in order, for example, to contact the shield conductor to the grounding section attached to the housing or to release the electrical cable from the connection device.

The housing and the spring element may, for example, be embodied as stamped and bent parts.

The spring element may have, for example, an actuating leg pivotably supported on the housing and connected with the clamping leg that is movable into clamping engagement with the shield conductor of the electrical cable inserted in the receiving space, the actuating leg being bent over relative to the clamping leg. The actuating leg may be latchable to the housing so as to fix the position of the spring element relative to the housing when in the clamped position. Via the actuating leg, a user can, for example, manually act on the spring element and, for example, push the spring element toward its clamped position so as to electrically contact the shield conductor to the grounding section. While this occurs, the spring element comes into clamping engagement with the shield conductor via the clamping leg, so that the shield conductor is pressed against the grounding section in a contacting manner, thereby establishing an electrical contact between the shield conductor and the grounding section.

Preferably, the clamping leg is additionally curved in the region of its engagement portion about the pivot axis about which the spring element is pivotably connected to the housing. Thus, in the region of the engagement portion, the clamping leg is provided with a curved or angled contour in the plane perpendicular to the longitudinal axis and, in addition, is curved about the pivot axis (extending transversely to the longitudinal axis). Because the engagement of the clamping leg with the shield conductor of the electrical cable is not effected via a (sharp) end edge, but via the curved engagement portion, it is possible to achieve an areal engagement of the clamping leg with the shield conductor. Due to the curvature of the engagement portion, the clamping leg conforms to the shield conductor and makes areal contact therewith without any sharp edges coming into contact with the shield conductor (which could otherwise cause damage to the shield conductor).

Via the actuating leg, the spring element is preferably latched to the housing when in the clamped position. For this purpose, the actuating leg preferably has a latching device, which may be formed, for example, by latching noses on an end portion of the actuating leg remote from the clamping leg. Via the latching noses, the actuating leg snaps into engagement with, for example, latching projections on the housing, so that the actuating leg is interlockingly fixed in place when in its clamped position and thus retained in the clamped position.

To close the connection device, the spring element is pushed toward the clamped position, for example by pressing on the actuating leg. In the clamped position, the spring element clamps the shield conductor of the electrical cable against the grounding section attached to the housing, so that the shield conductor is electrically contacted to the grounding section. The spring element can be released from the closed position, for example by a user engaging a tool, such as a screwdriver, into a tool engagement aperture in the end portion of the actuating leg, thus releasing the latched engagement between the latching noses of the actuating leg and the latching projections of housing. Upon release of the latched engagement, the spring element springs out of the clamped position due to the resilient bias of the clamping leg (caused by the engagement with the shield conductor of the electrical cable), so that the connection device is opened and the housing can be removed from the grounding section, and the electrical cable can be removed from the housing.

However, it is also a conceivable and possible that the spring element may be opened without the use of a tool.

In an embodiment, the spring element is supported on the housing such that it is pivotable about the pivot axis. To provide the pivotable mounting, the actuating leg may have formed thereon two opposite hinge lugs which project from the actuating leg and which are, for example, engaged by hinge pins disposed on the housing, so that the spring element is articulated to the housing.

The housing may be configured, for example, as a single piece. In an embodiment, the housing may have, for example, two side walls extending parallel to each other along a transverse direction and a base connecting the side walls, the receiving space being formed between the side walls. Thus, the housing may have, for example, a U-shape in cross section, into which the electrical cable can be inserted with the stripped shield conductor. The shield conductor may, for example, be insertable into the housing in such a manner that the shield conductor extends along the longitudinal axis through the receiving space between the side walls when in the clamped position. The shield conductor may be inserted into the receiving space, for example, in an insertion direction transverse to the longitudinal axis and transverse to the transverse direction along which the side walls are spaced apart from each other. Therefore, the electrical cable does not need to be threaded through the housing, but can easily be inserted into the housing along the insertion direction, so that the shield conductor comes to rest in the receiving space of the housing.

In order to electrically contact the shield conductor of the electrical cable to a grounding section, it is preferred to first insert the electrical cable with the stripped shield conductor into the housing of the connection device. Then, the housing can be attached along with the electrical cable disposed thereon to the grounding section, for example, a busbar serving for grounding purposes, a mounting rail, or a portion of a housing wall of an electrical system, such as a control cabinet or the like. Once the housing has been attached to the grounding section, the grounding section extends through the receiving space, preferably along the transverse direction along which the side walls of the housing are spaced apart from each other. For this purpose, the side walls of the housing may have recesses which are matched in shape to the shape of the grounding section, and thus are able to receive the grounding section, for example, a metallic conductor of rectangular cross section.

The electrical cable and the grounding section thus extend along different directions relative to the housing. While the electrical cable is routed through the housing along the longitudinal axis, the grounding section extends through the receiving space transversely to the electrical cable along the transverse direction.

There are at least two conceivable and possible variants for attaching the housing to the grounding section, which may take the form of, for example, a busbar, a mounting rail, or a portion of a housing wall. For example, the recesses may be formed in the form of slots in the side walls of the housing and in such a way that the connection device can be attached to the grounding section on the side of the pivot axis via which the spring element is pivotably connected to the housing. In this case, the shield terminal may in particular be attachable to the grounding section even when the spring element is closed (spring element in the clamped position) and, in addition, strain relief may be improved. Alternatively, the recesses are formed in the side walls in such a way that the connection device can be slid onto the grounding section on a side of the housing remote from the pivot axis. This may allow for a design where the length that is stripped to expose the shield conductor can be shorter. In this case, in addition, the direction in which the connection device is fitted to the grounding section and the closing movement of spring element are oriented in substantially the same direction, which may provide increased ease of handling.

In the clamped position, preferably, the spring element, on the one hand, and the grounding section, on the other hand, of the (stripped) shield conductor of the electrical cable come to rest. The shield conductor is thus received between the spring element and the grounding section and pressed into direct electrically contacting engagement with the grounding section through clamping engagement of the spring element with the shield conductor.

The concept underlying the invention will be described below in more detail with reference to the exemplary embodiments shown in the figures.

FIGS. 1 through 4 show, in schematic view, a first exemplary embodiment of a connection device 1 that serves to electrically contact a shield conductor 20 in the form of an electrically conductive shielding braid of an electrical cable 2.

Electrical cable 2 includes, for example, a plurality of electrical wires 22 to 20, which are surrounded by the shield conductor 20 in the form of the shielding braid. Shield conductor 20 is covered on the outside by an electrically insulating jacket 21, so that shield conductor 20 is electrically insulated toward the outside where it is not stripped.

Connection device 1 allows shield conductor 20 of electrical cable 2 to be electrically contacted to a grounding section 3 in the form of a metallic conductor, for example, a busbar, a mounting rail, or a housing wall of an electrical system. Shield conductor 20 can thus be brought to the ground potential of the grounding section 3, so that grounding of shield conductor 20 is provided through connection device 1.

Generally, a plurality of electrical cables 2 can be disposed on and electrically grounded at grounding section 3.

Figure 2:
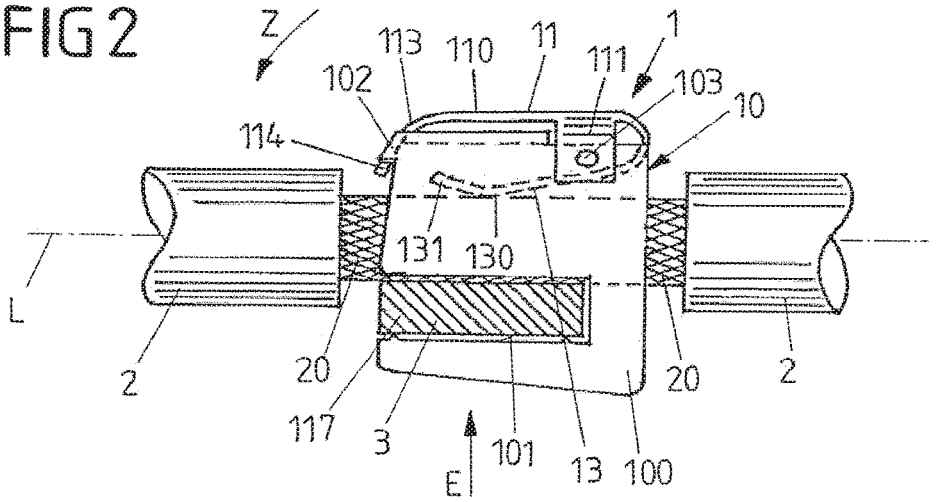
FIG. 2 is a side view of the connection device.
Figure 3:
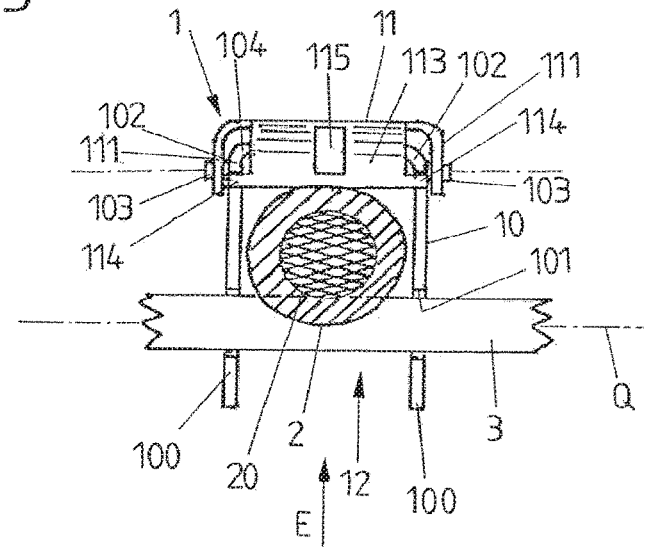
FIG. 3 is a front view of the connection device.
Figure 4:
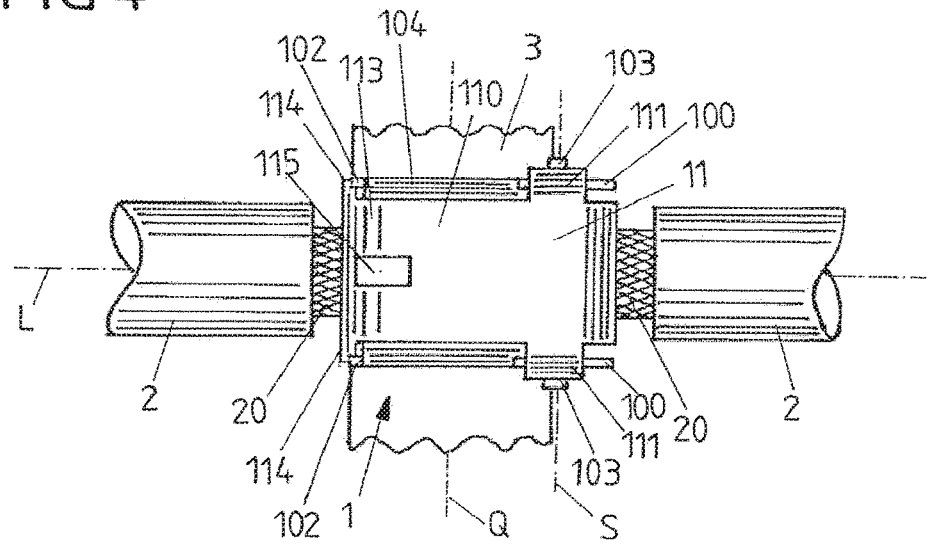
FIG. 4 is a plan view of the connection device.
Figure 5:
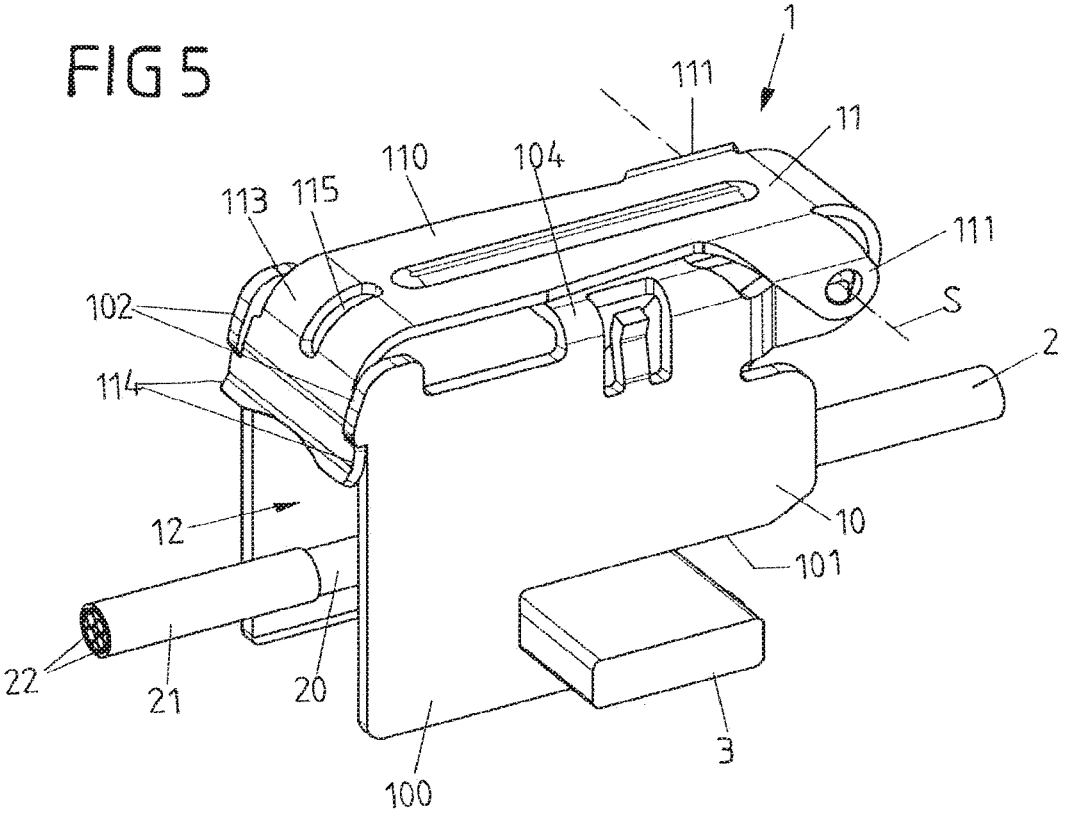
FIG. 5 is a perspective view of another exemplary embodiment of a connection device.
Figure 6:
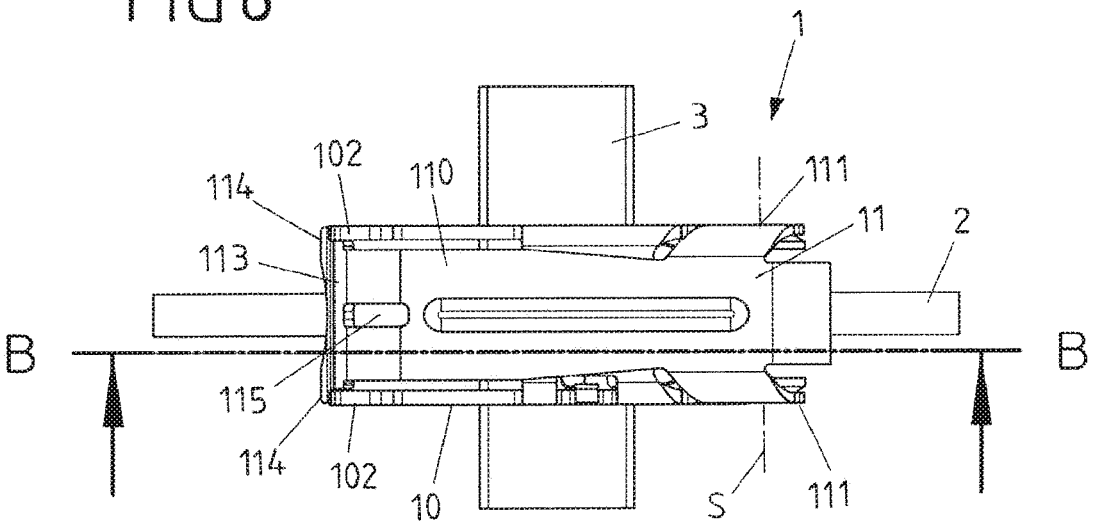
FIG. 6 is a plan view of the connection device of FIG. 5.
Figure 7:
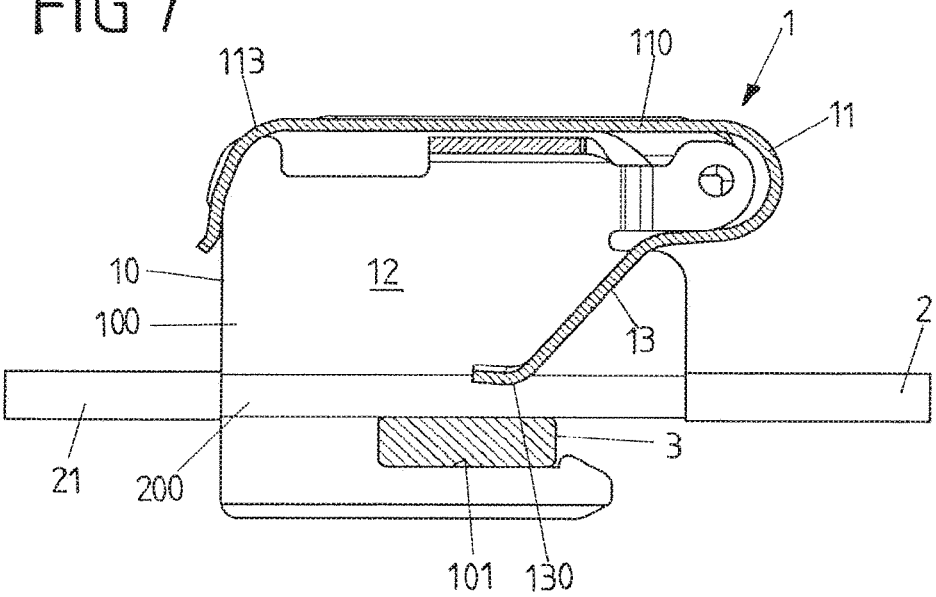
FIG. 7 is a sectional view taken along line B-B in FIG. 6.
Figure 8:
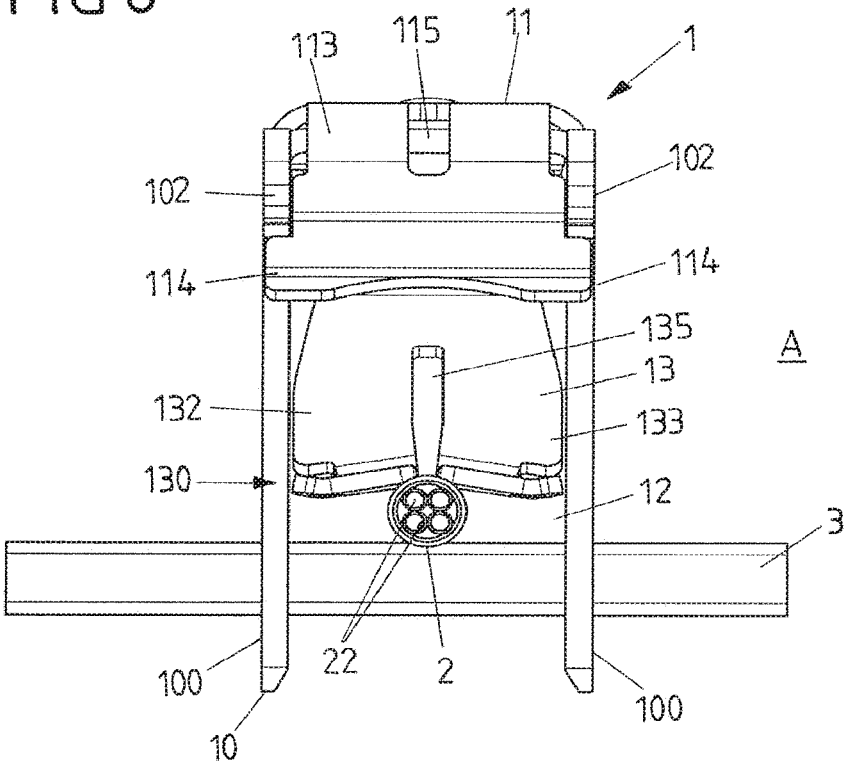
FIG. 8 is a frontal view of the connection device.

In the exemplary embodiment shown, as seen in the views of FIGS. 2 through 4, connection device 1 has a housing 10 formed by two parallel side walls 100 spaced apart from each other along a transverse direction Q, and a base 104 connecting the side walls 100. Housing 10 is preferably manufactured as a single piece, for example, as stamped and bent parts from a metal sheet.

A spring element 11 is supported on housing 100 such that it is pivotable about a pivot axis S, the spring element including an actuating leg 110 and a clamping leg 13 that is bent over relative to actuating leg 110. The spring element is 11 is manufactured, for example, as a stamped and bent part from a spring steel material and is in itself elastically resilient, so that actuating leg 110 and clamping leg 13 can be elastically adjusted in position relative to each other.

FIGS. 2 through 4 show spring element 11 in a clamped position in which spring element 11 is in clamping engagement with the stripped shield conductor 20 of electrical cable 2 via clamping leg 13, pressing shield conductor 20 into electrically contacting engagement with the grounding section 3 extending through housing 10. In this clamped position, spring element 11 is in latched engagement, via latching noses 114 formed on an end portion 113 of actuating leg 110 remote from clamping leg 13, with latching projections 102 formed on opposite sides walls 100, so that spring element 11 is interlockingly retained in its clamped position relative to housing 10.

In this clamped position, clamping leg 13 is in engagement with shield conductor 20 of electrical cable 2 via an engagement portion 130 spaced apart from an end edge 131. In the region of this engagement portion 130, clamping leg 13 is curved (in the plane perpendicular to pivot axis S), so that no sharp-edged portions of clamping leg 13 (in particular not the end edge 131) engage with shield conductor 20, and thus an areal engagement is provided between clamping leg 13 and shield conductor 20.

In the clamped position, spring leg 13 is resiliently biased relative to actuating leg 110 by spring element 11 being pressed into the clamped position and, in this clamped position, being latched to housing 10 via actuating leg 110. The elasticity of spring element 11 makes it possible, for example, to compensate for (aging-related) yielding of shield conductor 20 of electrical cable 2 without the electrical contact between the shield conductor 20 and grounding section 3 being impaired by such yielding.

Spring element 11 has two opposite hinge lugs 111 on actuating leg 110, which are each articulated to a respective one of the side walls 100 of housing 10, and to this end are hinged on hinge pins 103 of side walls 100. Spring element is 11 is thus pivotable about hinge pins 103 and in particular is movable between an open position, in which spring element 11 has been released from the clamped position in a direction opposite to closing direction Z, and the clamped position.

Side walls 100 of housing 10 have recesses 101 formed therein opposite each other, in which recesses grounding section 3 can be received in such a way that when attached to housing 10, grounding section 3 extends along transverse direction Q through a receiving space 12 of housing 10 formed between side walls 100, as can be seen, for example, from FIG. 3

In contrast, electrical cable 2 can be inserted with the partially stripped shield conductor 20 into receiving space 12 in an insertion direction E from a side opposite the base 104 of housing 10, so that when in the inserted position, electrical cable 2 extends through receiving space 12 of housing 10 along a longitudinal axis L transverse to transverse direction Q and transverse to insertion direction E.

In order to electrically contact shield conductor 20 of electrical cable 2 to grounding section 3, initially, electrical cable 2 is inserted with the partially stripped shield conductor 20 into receiving space 12 in insertion direction E. While this occurs, spring element 11 is normally in its open position, in which spring element 11 has been moved from the clamped position in a direction opposite to closing direction Z.

Then, connection device 1 is attached along with the electrical cable 2 disposed thereon to grounding section 3 by bringing housing 10 into interlocking engagement with grounding section 3 via recesses 101. Thus, grounding section 3 extends through receiving space 12 of housing 10 in such a manner that spring element 11 and grounding section 3 come to rest on different sides of electrical cable 2.

Spring element 11 is then moved into the clamped position shown in FIGS. 2 through 4 by pressing on actuating leg 110, and for this purpose is pushed in closing direction Z until actuating leg 110 snaps with its latching noses 114 disposed on end portion 113 into engagement with latching projections 102 on side walls 100 of housing 10. In this way, the spring leg 13 comes into clamping contact with shield conductor 20 and is resiliently biased, so that shield conductor 20 is pressed with sufficient contact force into contacting engagement with grounding section 3.

When electrical cable 2 is to be removed from grounding section 3, a user can engage a suitable tool, such as a screwdriver, into a tool engagement aperture 115 in the form of an opening in end portion 113 of actuating leg 110 to thereby release the latched engagement between actuating leg 110 and housing 10 by (resiliently) flexing the end portion 113. Due to the bias of spring leg 13, spring element 11 springs out of its clamped position, thereby opening connection device 1 and allowing housing 10 to be removed from grounding section 3, and allowing electrical cable 2 to be removed from housing 10.

Another exemplary embodiment of a connection device 1, shown in FIGS. 5 through 8, is functionally substantially identical to the exemplary embodiment described previously with reference to FIGS. 1 through 4 and, therefore, reference is made to the entirety of the explanations concerning the exemplary embodiment of FIGS. 1 through 4. In the different exemplary embodiments described herein, components having the same functions are given the same reference numerals throughout. In contrast to the exemplary embodiment shown in FIGS. 1 through 4, in the exemplary embodiment of FIGS. 5 through 8, recesses 101 in side walls 100 of housing 10 are oriented in the opposite direction. While in the exemplary embodiment illustrated in FIGS. 1 through 4, connection device 1 can be attached to grounding section 3 via the side of housing 10 remote from pivot axis S of spring element 11 by fitting housing 10 onto grounding section 3 along the longitudinal axis L, the connection device 1 according to the exemplary embodiment shown in FIGS. 5 through 8 has to be attached to grounding section 3 in the opposite direction, namely via the side of housing 10 where pivot axis S of spring element 11 is located.

Both in the exemplary embodiment of FIGS. 1 through 4 and in the exemplary embodiment of FIGS. 5 through 8, clamping leg 13 of spring element 11 is configured such that, when viewed in a plane A perpendicular to the longitudinal axis (which corresponds to the drawing plane of FIG. 8 and FIG. 11), an engagement contour K is formed on engagement portion 130 which engagement contour K does not extend in a straight line, but is matched in shape to the curved surface of shield conductor 20 of electrical cable 2.

Figure 9:
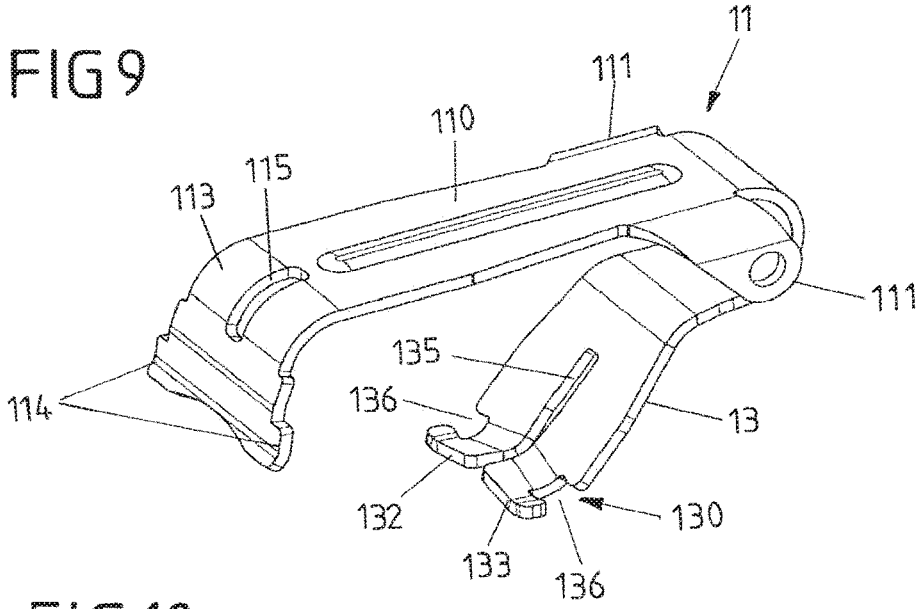
FIG. 9 is a separate view of a spring element of the connection device.
Figure 10:
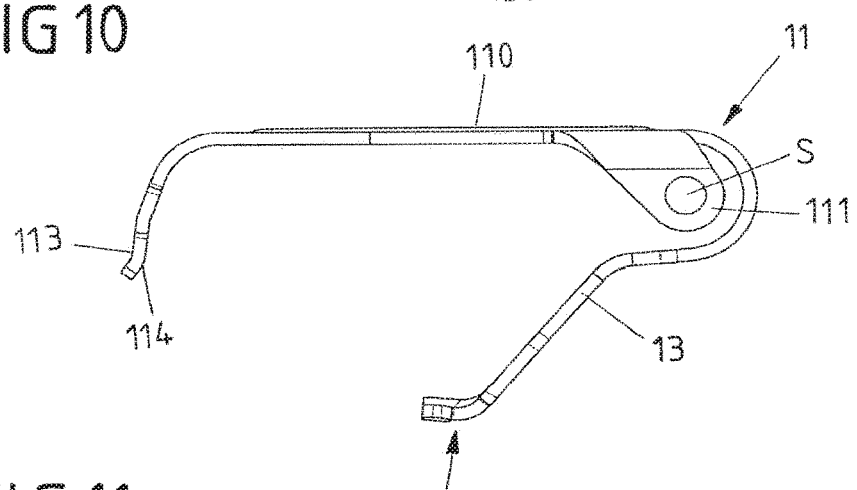
FIG. 10 is a side view of the spring element.
Figure 11:
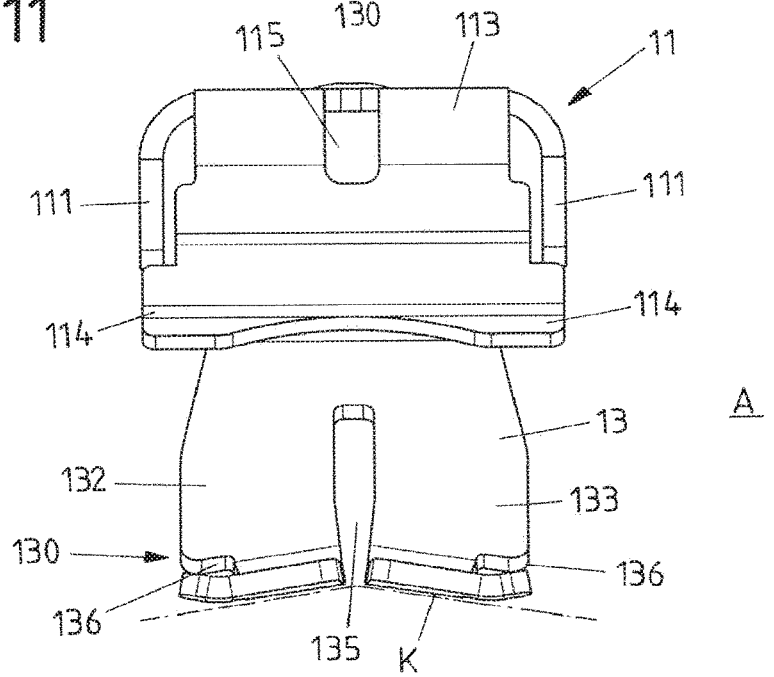
FIG. 11 is a frontal view of the spring element.
Figure 12:
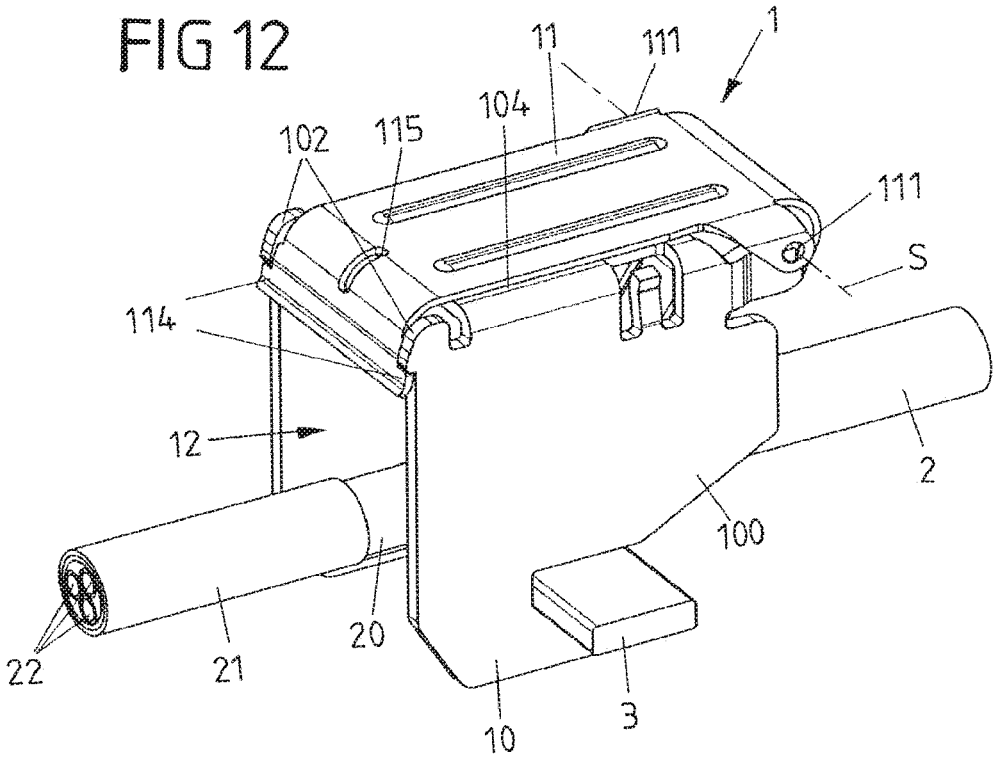
FIG. 12 is a perspective view of a further exemplary embodiment of a connection device.
Figure 13:
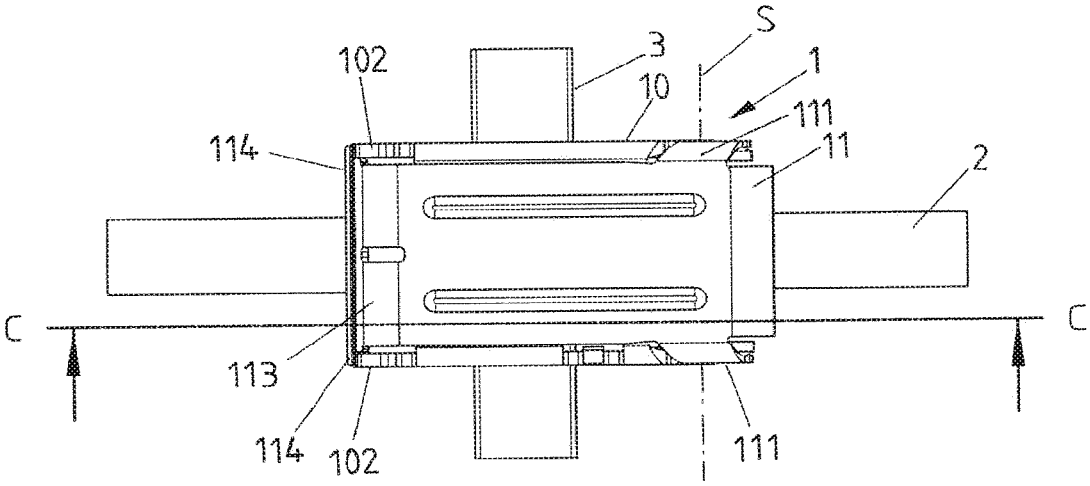
FIG. 13 is a plan view of the connection device of FIG. 12.
Figure 14:
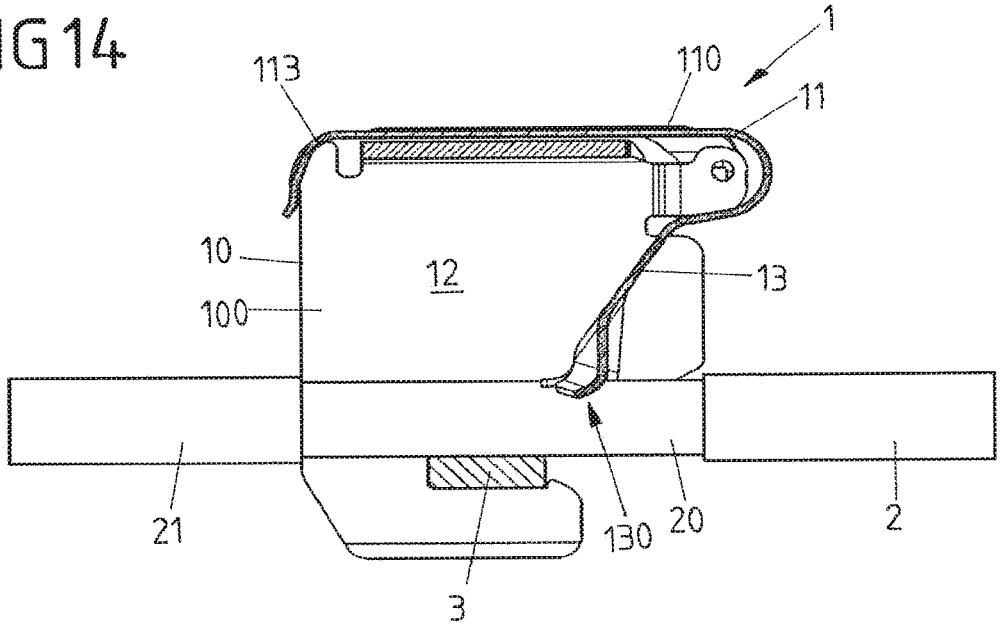
FIG. 14 is a sectional view taken along line C-C in FIG. 13.
Figure 15:
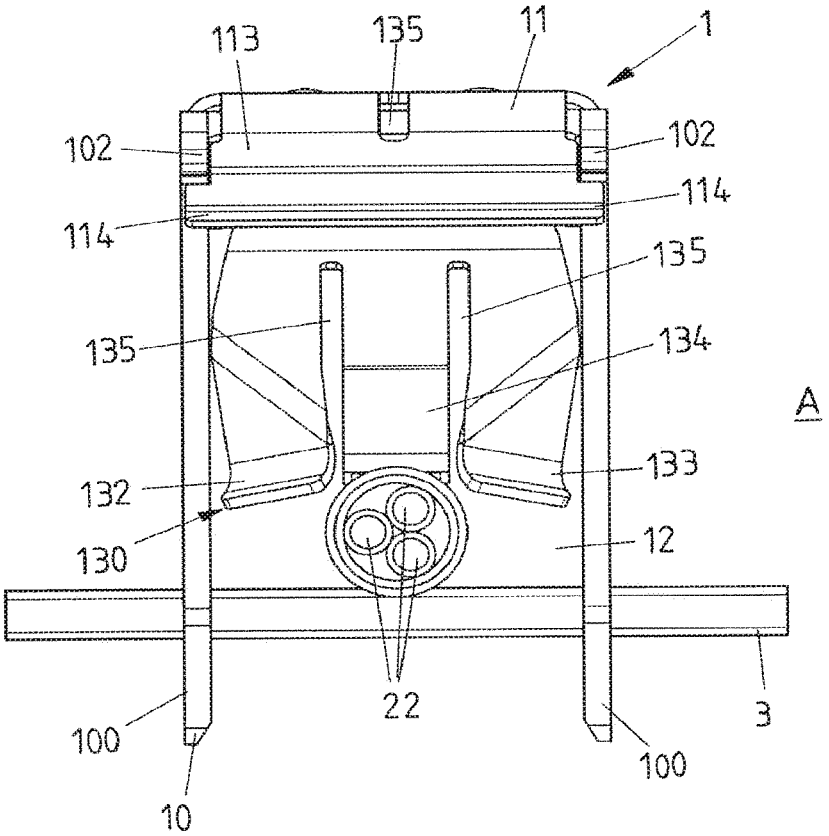
FIG. 15 is a frontal view of the connection device.

For example, in the case of the spring element 11 shown separately in FIGS. 9 through 11, clamping leg 13 is formed with two contact portions 132, 133 which are separated from each other by a slit 135 extending lengthwise in clamping leg 13. Contact portions 132, 133 are formed in the manner of contact tongues and are resiliently deflectable relative to one another, so that contact portions 132, 133 can elastically conform to shield conductor 20 of electrical cable 2 as the spring element 11 is moved into the clamped position (see FIG. 8).

In the illustrated exemplary embodiment of spring element 11, contact portions 132, 133 are angled relative to each other to form engagement contour K for engagement with shield conductor 20. In addition, contact portions 132, 133 are convexly curved at their outer sides that face away from each other and, in addition, have recesses 136 formed therein at these outer sides, the recesses increasing the elasticity of contact portions 132, 133 at their ends for engagement with shield conductor 20.

By providing engagement contour K, it is made possible for clamping leg 13 to engage with shield conductor 20 of electrical cable 2 in an advantageous manner. As can be seen, for example, from FIG. 8, the firm seating of cable 2 in receiving space 12 of housing 10 can also be improved in this way, because electrical cable 2 is locked in position within receiving space 12 in the plane A perpendicular to longitudinal axis L through engagement with engagement contour K.

By providing engagement contour K, it is also possible to achieve engagement of clamping leg 13 with shield conductor 20 over a large area.

As an alternative to the angled configuration of engagement contour K, in the exemplary embodiment of spring element 11 shown in FIGS. 9 through 11, engagement contour K may have a semicircular shape. For this purpose, contact portions 132, 133 may each be concavely curved in the region of their ends to form engagement portion 130, so that contact portions 132, 133 together form the shape of a semicircle at their ends.

Figure 16:
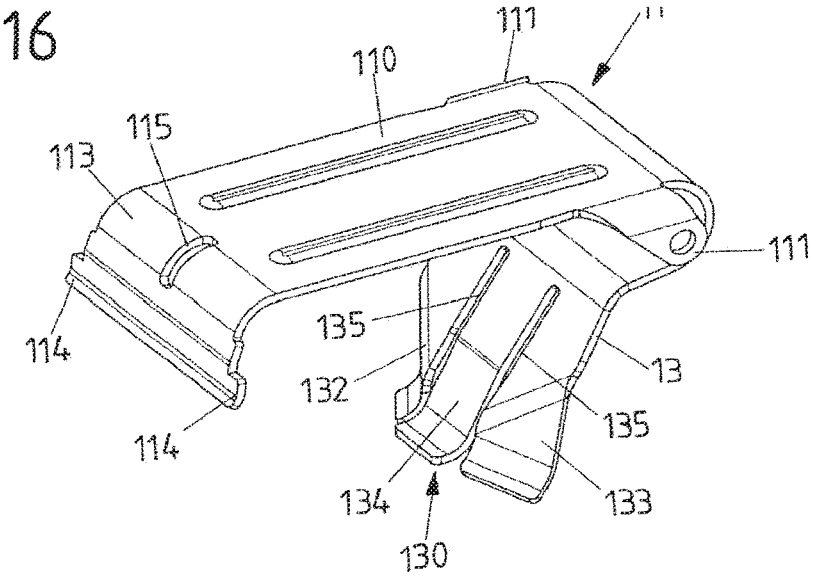
FIG. 16 is a separate view of the spring element of the connection device.
Figure 17:
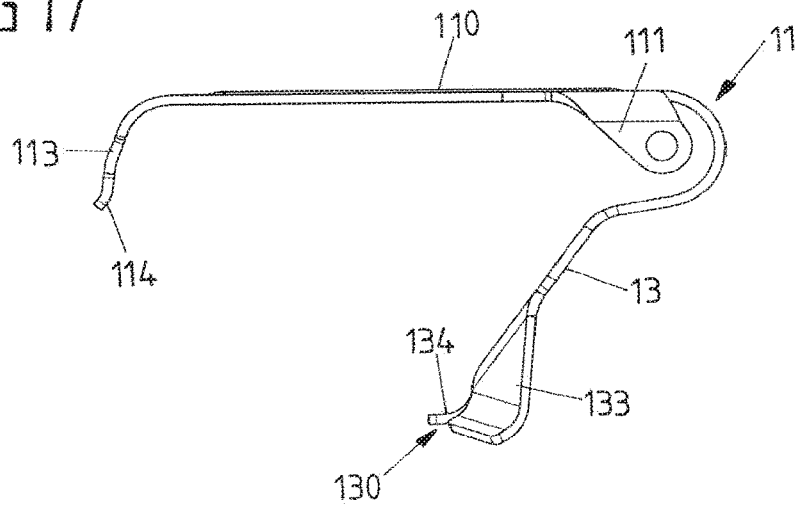
FIG. 17 is a side view of the spring element.
Figure 18:
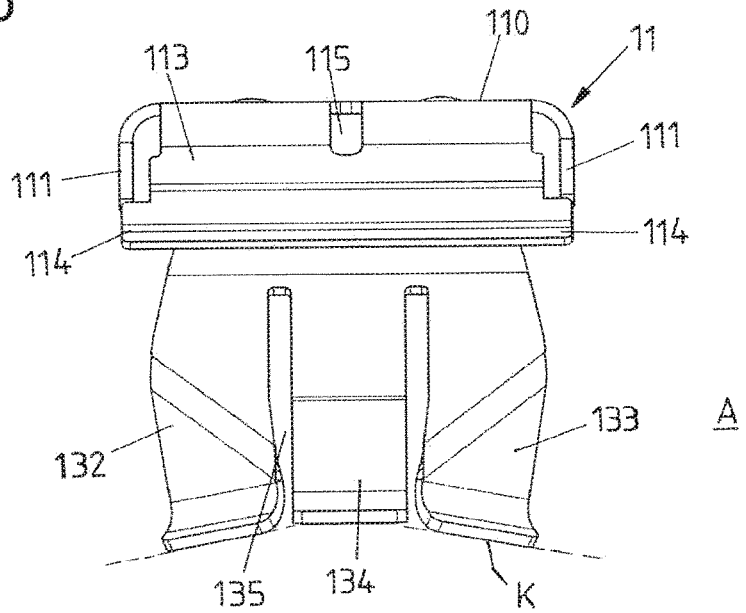
FIG. 18 is a frontal view of the spring element.

In another exemplary embodiment, shown in FIGS. 12 through 15, housing 10 has disposed thereon the spring element 11 shown in separate views in FIGS. 16 through 18. Spring element 11 is formed at its clamping leg 13 with three contact portions 132, 133, 134 in the form of contact tongues which are separated from each other by respective slits 135 and thus movable resiliently relative to one another.

As can be seen from FIG. 18, contact portions 132, 133, 134 together form an engagement contour K in the plane A perpendicular to longitudinal axis L (which corresponds to the drawing plane of FIG. 18 and FIG. 15), via which clamping leg 13 can be brought into engagement with the shield conductor 20 of a cable 2 inserted into receiving space 12 of housing 10 of connection device 1.

The use of more than two contact portions 132, 133, 134, allows engagement contour K to be matched to the shape of a (nominally associated) shield conductor 20, so that contact portions 132, 133, 134 can rest against shield conductor 20 in an advantageous manner over a certain surface area thereof. The elastic design allows contact portions 132, 133, 134 to engage with shield conductor 20 in an advantageous manner, thereby compensating for tolerances.

In the exemplary embodiment of FIGS. 12 through 15, contact portions 132, 133, 134 each extend in a straight line in plane A, but are angled relative to each other, so that, for example, the engagement contour K illustrated in FIG. 18 is obtained. Alternatively, contact portions 132, 133, 134 may at least partially be (convexly or concavely) curved at their ends in plane A.

With the exception of the configuration of spring element 11, the exemplary embodiment of FIGS. 12 through 15 is functionally identical to the exemplary embodiments shown in FIGS. 1 through 4 and in FIGS. 5 through 8, so that reference is made to the explanations concerning the preceding exemplary embodiments in regard to the operation of connection device 1.

As regards the insertion direction for attaching connection device 1 to grounding section 3, the exemplary embodiment of FIGS. 12 through 15 corresponds to the exemplary embodiment shown in FIGS. 5 through 8.

In the exemplary embodiment of FIGS. 1 through 4, spring element 11 may be implemented, for example, like the spring element illustrated in FIGS. 9 through 11 or like the one shown in FIGS. 16 through 18, or in another way.

For example, spring element 1 may have two, three, or even more contact portions 132, 133, 134.

The concept underlying the invention is not limited to the above-described embodiments, but may also be implemented in a completely different way.

The connection device provided can be simple in construction and use only a few components. In particular, the connection device can basically be made from a housing part and a spring element. Other components can be omitted. This results in a simple, cost-effective manufacture and a compact design.

Moreover, the connection device can provide an advantageous, reliable, stable contact force for electrically contacting a shield conductor to a grounding section. The connection device can be easy and intuitive to use and allow a contact to be released. The connection device can in principle also be implemented differently than described herein. For example, the housing may have a different shape.

The housing may preferably be manufactured from a metal, for example as a stamped and bent part. However, this is not absolutely necessary. In principle, it is also conceivable and possible for the housing to be made from plastic.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE CHARACTERS

1 connection device
10 housing
100 side walls
101 recess
102 latching projection
103 hinge pin
104 base
11 spring element
110 actuating leg
111 hinge lug
113 end portion
114 latching noses
115 tool engagement aperture
12 receiving space
13 clamping leg
130 engagement portion
131 end edge
132, 133, 134 contact portion (contact tongue)
135 slit
136 recess
2 cable
20 shield conductor
21 jacket
22 wires
3 grounding section
A plane
E insertion direction
K engagement contour
L longitudinal axis
S pivot axis
Z closing direction

The invention claimed is:

1. A connection device for connecting a shield conductor of an electrical cable to a grounding section, the connection device comprising:

a housing surrounding a receiving space into which an electrical cable is insertable with a shield conductor along a longitudinal axis, the housing being attachable to the grounding section such that the grounding section extends at least partly in the receiving space; and a spring element which is adjustably disposed on the housing and which has a clamping leg and is movable from an open position to a clamped position relative to the housing such that when in the clamped position, the spring element is configured to act with the clamping leg on the shield conductor of the electrical cable inserted in the receiving space, the clamping leg having an engagement portion configured to act on the shield conductor, the engagement portion having an at least partially curved or angled engagement contour at a side facing the shield conductor as viewed in a plane perpendicular to the longitudinal axis.

2. The connection device as recited in claim 1, wherein the spring element is pivotable about a pivot axis relative to the housing.

3. The connection device as recited in claim 1, wherein the connection device is configured to hold the shield conductor of the electrical cable in the clamped position between the spring element and the grounding section.

4. The connection device as recited in claim 1, wherein the engagement portion has a first contact portion and a second contact portion, which form the engagement contour.

5. The connection device as recited in claim 4, wherein the first contact portion and the second contact portion are separated from each other by a slit.

6. The connection device as recited in claim 4, wherein the first contact portion and the second contact portion are angled relative to each other when viewed in the plane perpendicular to the longitudinal axis.

7. The connection device as recited in claim 4, wherein the clamping leg has at least a third contact portion disposed between the first contact portion and the second contact portion.

8. The connection device as recited in claim 7, wherein the third contact portion is separated by slits from the first contact portion and the second contact portion.

9. The connection device as recited in claim 7, wherein the third contact portion is angled relative to both the first contact portion and the second contact portion as viewed in the plane perpendicular to the longitudinal axis.

10. The connection device as recited in claim 1, wherein the spring element has an actuating leg that is pivotably supported on the housing and bent over relative to the clamping leg.

11. The connection device as recited in claim 10, wherein the clamping leg is curved about the pivot axis in a region of the engagement portion.

12. The connection device as recited in claim 10, wherein the actuating leg has a latching device configured to provide a latching connection to the housing in the clamped position.

13. The connection device as recited in claim 10, wherein the actuating leg has at least one hinge lug projecting therefrom via which the actuating leg is pivotably connected to the housing.

14. The connection device as recited in claim 10, wherein the actuating leg has at least one latching nose on an end portion remote from the clamping leg configured to provide latching engagement with at least one latching projection of the housing in the clamped position.

15. The connection device as recited in claim 14, wherein the end portion of the actuating leg is provided with a tool engagement aperture for releasing configured to release the spring element from the clamped position.

16. The connection device as recited in claim 1, wherein the housing has two side walls extending parallel to each other and spaced apart along a transverse direction and a base connecting the side walls, the receiving space being formed between the side walls.

17. The connection device as recited in claim 16, wherein the shield conductor of the electrical cable is insertable into the housing such that the shield conductor extends along the longitudinal axis through the receiving space between the side walls.

18. The connection device as recited in claim 16, wherein the shield conductor of the electrical cable is insertable into the receiving space in an insertion direction transverse to the longitudinal axis and transverse to the transverse direction.

19. The connection device as recited in claim 16, wherein the housing is attachable to the grounding section such that the grounding section extends through the receiving space along the transverse direction.

20. The connection device as recited in claim 16, wherein the side walls have recesses configured to receive the grounding section.

21. An assembly comprising an electrical cable having a shield conductor, a grounding section, and a connection device;

wherein the connection device comprising a housing surrounding a receiving space into which an electrical cable is insertable with a shield conductor along a longitudinal axis, the housing being attachable to the grounding section in such a way that the grounding section extends at least partly in the receiving space, and a spring element which is adjustably disposed on the housing and which has a clamping leg and is movable from an open position to a clamped position relative to the housing such that when in the clamped position, the spring element is configure to act with the clamping leg on the shield conductor of the electrical cable inserted in the receiving space, the clamping leg having an engagement portion configured to act on the shield conductor, the engagement portion having an at least partially curved or angled engagement contour at a side facing the shield conductor as viewed in a plane perpendicular to the longitudinal axis.

22. The assembly as recited in claim 21, wherein the grounding section is part of a mounting rail or a busbar.

* * * * *